US010826226B2

(12) United States Patent
Yin et al.

(10) Patent No.: US 10,826,226 B2
(45) Date of Patent: Nov. 3, 2020

(54) ELECTRICAL CABLE CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Ting-Ting Yin, Kunshan (CN); Bin Peng, Kunshan (CN); Jian-Kuang Zhu, Kunshan (CN); Kuo-Chun Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/744,196

(22) Filed: Jan. 16, 2020

(65) Prior Publication Data

US 2020/0244001 A1 Jul. 30, 2020

(30) Foreign Application Priority Data

Jan. 28, 2019 (CN) ..... 2019 2 0140231 U

(51) Int. Cl.

| | |
|---|---|
| ***H01R 24/00*** | (2011.01) |
| ***H01R 13/52*** | (2006.01) |
| ***H01R 13/04*** | (2006.01) |
| ***H01R 13/502*** | (2006.01) |
| ***H01R 4/02*** | (2006.01) |
| ***H01R 12/77*** | (2011.01) |

(Continued)

(52) U.S. Cl.

CPC ..... *H01R 13/521* (2013.01); *H01R 4/02* (2013.01); *H01R 12/592* (2013.01); *H01R 12/777* (2013.01); *H01R 12/79* (2013.01); *H01R 13/04* (2013.01); *H01R 13/502* (2013.01)

(58) Field of Classification Search

CPC .... H01R 13/64; H01R 13/26; H01R 23/7073; H01R 9/091; H01R 13/432

USPC ..... 439/699.1, 746, 680, 947, 79, 80, 747

See application file for complete search history.

(56) References Cited

U.S. PATENT DOCUMENTS 4,447,109 A * 5/1984 Hobart, Jr. ..... H01R 4/028 439/851

5,575,690 A * 11/1996 Eaton ..... H01R 13/187 439/176

(Continued)

FOREIGN PATENT DOCUMENTS

CN 205565228 U 9/2016

*Primary Examiner* — Phuong Chi Thi Nguyen

(74) *Attorney, Agent, or Firm* — Wei Te Chung; Ming Chieh Chang

(57) ABSTRACT

An electrical connector includes an insulative housing, a plurality of slit type passageways, a plurality of blade type contacts retained with the corresponding slit type passageways, respectively, and a plurality of wires having the inner conductors soldered upon the tails of the contacts behind the rear face of the housing. The rear face forms a plurality of standoffs on which the front ends of the exposed inner conductor abut, respectively. A waterproof glue plate fills the back space of the housing behind the rear face to enclose the exposed inner conductors and the corresponding tails and seal the rear face of the housing.

12 Claims, 8 Drawing Sheets

(51) Int. Cl.
*H01R 12/59* (2011.01)
*H01R 12/79* (2011.01)

(56) References Cited

U.S. PATENT DOCUMENTS 5,580,266 A * 12/1996 Shelly ..... H01R 13/53
439/281
5,595,496 A * 1/1997 Konda ..... H01R 13/5219
439/271
6,402,566 B1 * 6/2002 Middlehurst ..... H01R 13/113
439/680
10,541,488 B2 * 1/2020 Zebhauser ..... H01R 9/0518

* cited by examiner

ELECTRICAL CABLE CONNECTOR

BACKGROUND OF THE DISCLOSURE

1. Field of the Disclosure

The present disclosure relates to an electrical connector, and particularly to the electrical connector with the associated wires connected to the blade type contacts.

2. Description of Related Arts

The convention cable connector discloses the inner conductor of the wires soldered upon the tails of the blade type contacts behind the rear face of the housing, and a waterproof glue plate is further applied thereto to cover the rear face of the housing. Anyhow, if the diameter of the wire becomes larger to result in a relatively odd configuration of the space behind the rear face of the housing, the fluidal glue may not be capable of completely filling the space behind the rear face of the housing, thus jeopardizing the waterproofing effect.

An improved connector is desired to provide the electrical cable connector with the good waterproofing function even if the wire having the relative large diameter is soldered upon the tail of the blade type contact.

SUMMARY OF THE DISCLOSURE

An object of the invention is to provide an electrical connector with an insulative housing, a plurality of slit type passageways, a plurality of blade type contacts retained with the corresponding slit type passageways, respectively, and a plurality of wires having the inner conductors soldered upon the tails of the contacts behind the rear face of the housing. The rear face forms a plurality of standoffs on which the front ends of the exposed inner conductor abut, respectively. A waterproof glue plate fills the back space of the housing behind the rear face to enclose the exposed inner conductors and the corresponding tails and seal the rear face of the housing.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
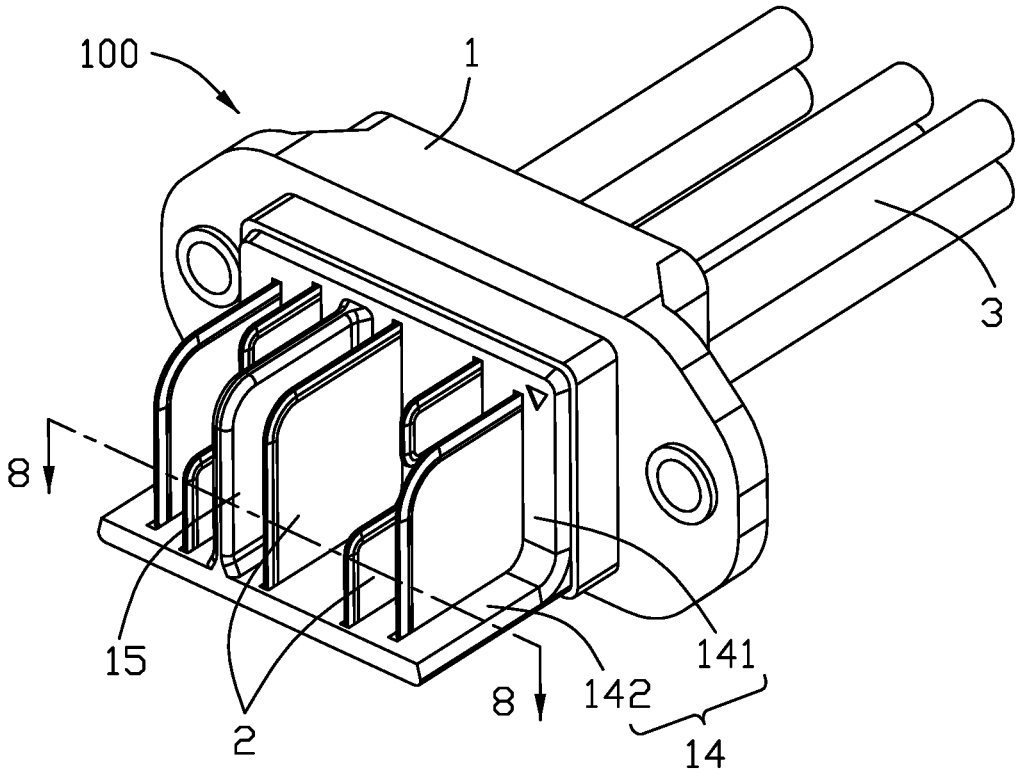
FIG. 1 is a perspective view of an electrical connector of the invention.
Figure 2:
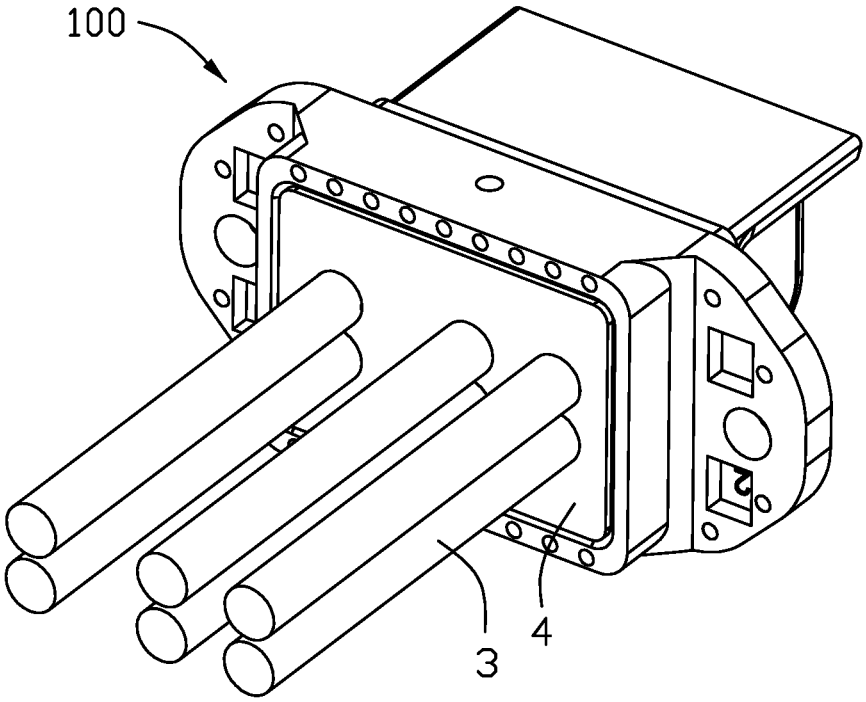
FIG. 2 is another perspective view of the electrical connector of FIG. 1.

Referring to FIGS. 1-9, an electrical connector 100 includes an insulative housing 1 having a peripheral wall 18 to surround a receiving cavity 19 in a rear side with a rear/supporting face 11 rearward facing toward an exterior, and a plurality of slit type passageways 12 extending along the front-to-back direction. A plurality of contacts 2 are received within the corresponding passageways 12, respectively. Each contact 2 includes a front contacting section 21 exposed in a front side of the housing 1, a rear soldering tail 23 exposed in the receiving cavity 19, and a middle retaining section 22 therebetween in the front-to-back direction. A plurality of standoffs 13 are formed on the rear face 11 and beside the corresponding soldering tails 23, respectively. A plurality of wires 3 have the corresponding inner conductors 31 with end sections exposed outside of the corresponding insulative jacket, soldering to the soldering tails 23 of the corresponding contacts 2 via the solder 6, and forwardly abutting against the corresponding standoffs 13, respectively. A waterproof glue plate 4 fills the receiving cavity 19 to seal the rear face 11.

The housing 1 further includes an L-shaped mating port 14 including a first mating face 141 and a second mating face 142 perpendicular to each other. The passageways 12 extend in both the first mating face 141 and the second mating face 142. A peripheral step 16 is located behind the mating port 14.

The contacts 2 include three first contacts 24, and two second contacts 25 and two third contacts 26 paired with each other. The soldering leg 23 of the first contact 24 forms a notch 231 to have the inner conductors 31 of the two wires 3 soldered to two positions by two sides of the notch 231, respectively. Because of the notch 231, the heat occurring at the exposed inner conductors 31 of the two wires 31 may be efficiently dissipated. So the temperature about the tail 23 may be lowered. The housing 1 forms a key 15 linked with both the first mating face 141 and the second mating face 142 in the mating port 14. In this embodiment, the wire 3 is of 14 AWG (American Wire Gauge), and the contacting section 21 is plated with both Palladium-Nickel (Pd—Ni) and Gold (Au).

Figure 3:
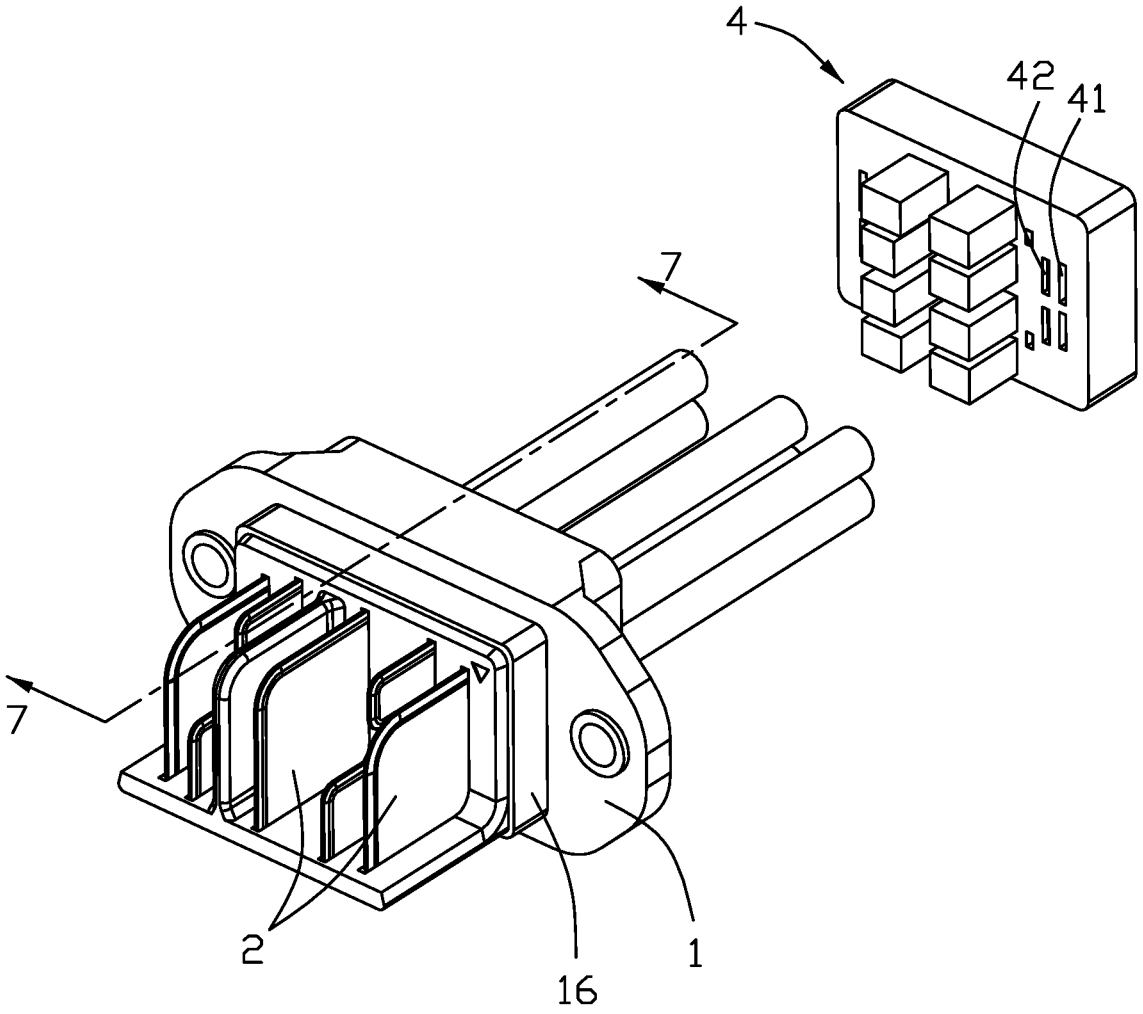
FIG. 3 is an exploded perspective view of the electrical connector of FIG. 1.
Figure 4:
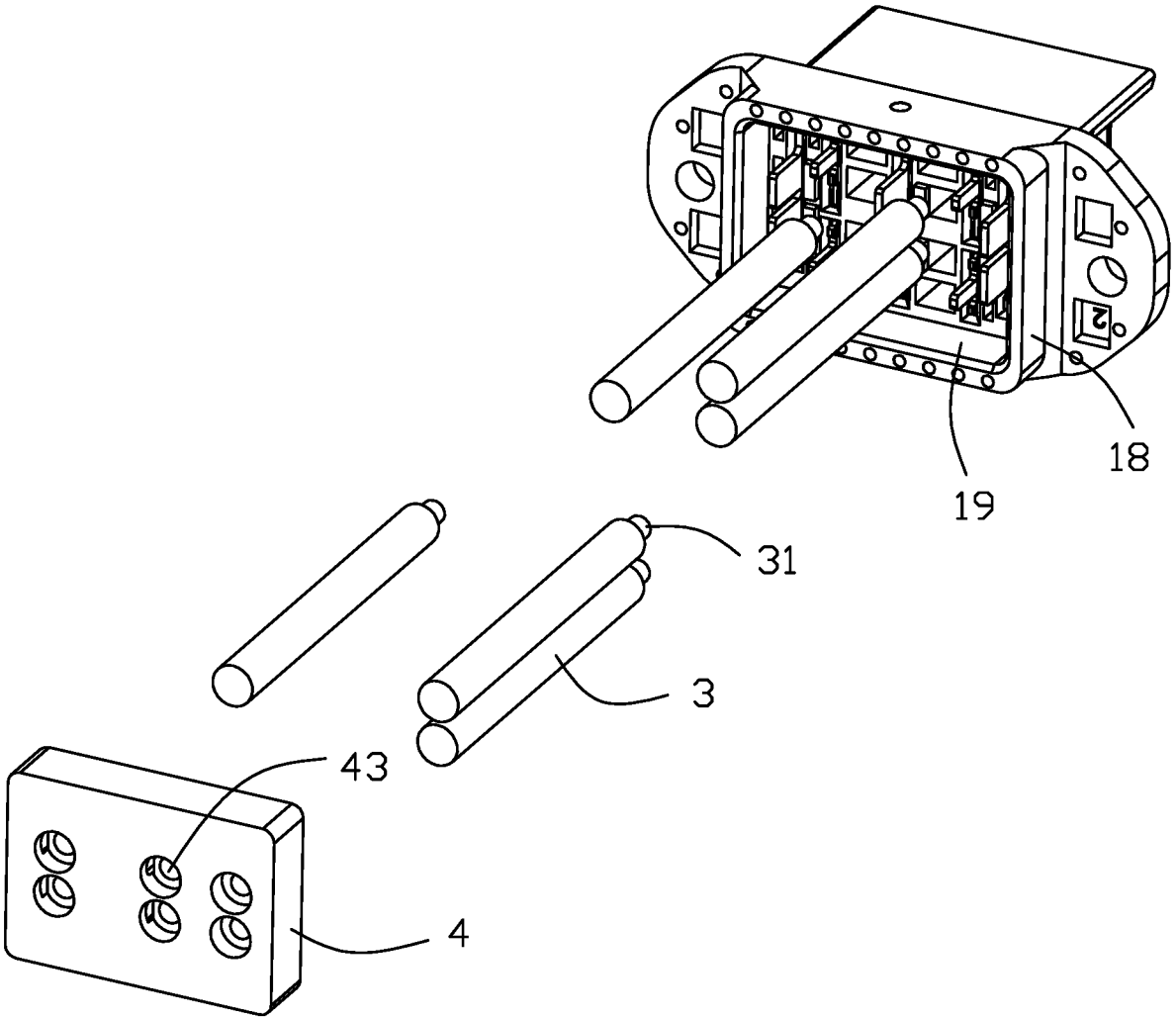
FIG. 4 is an exploded perspective view of the electrical connector of FIG. 2.
Figure 5:
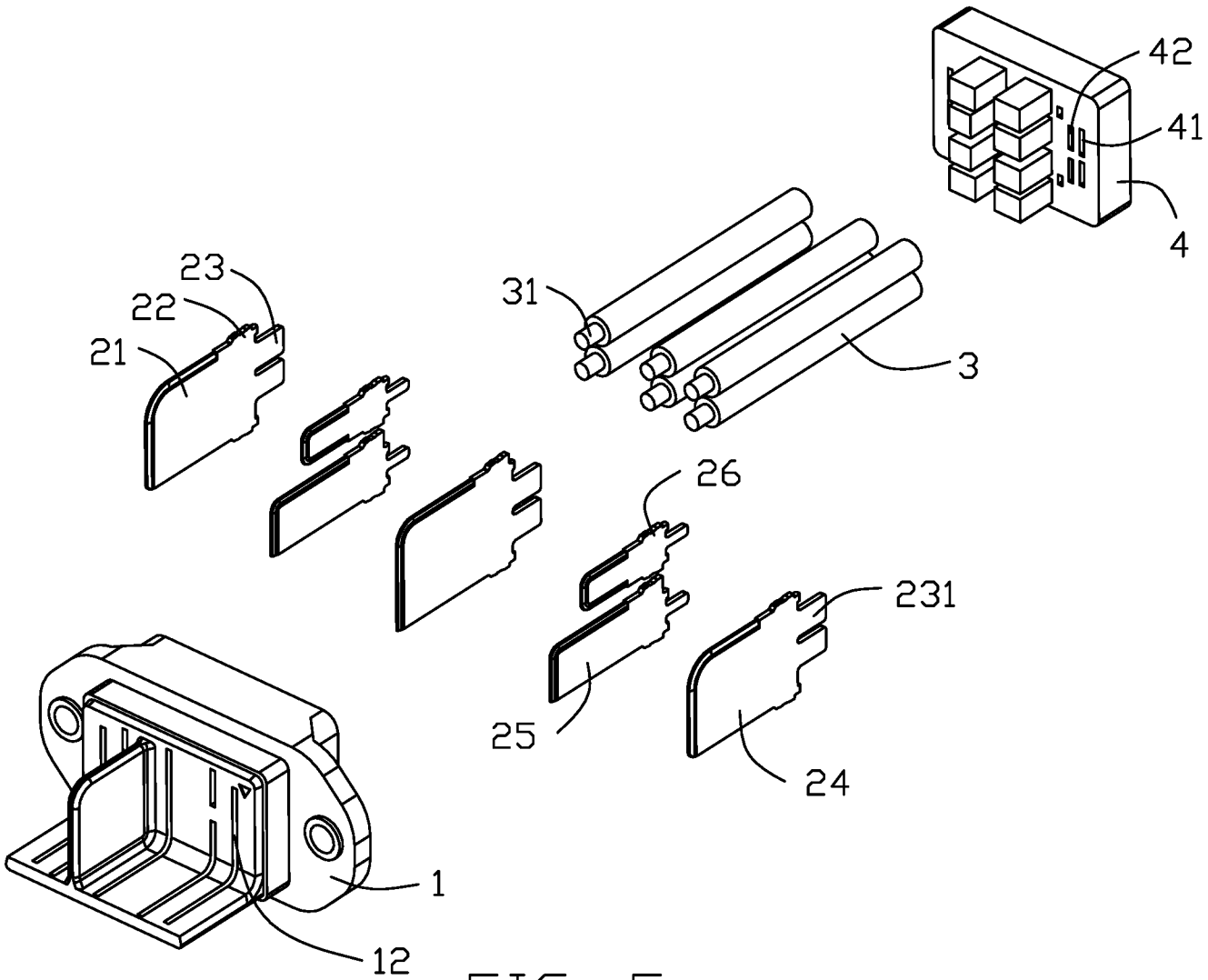
FIG. 5 is a further exploded perspective view of the electrical connector of FIG. 3.
Figure 6:
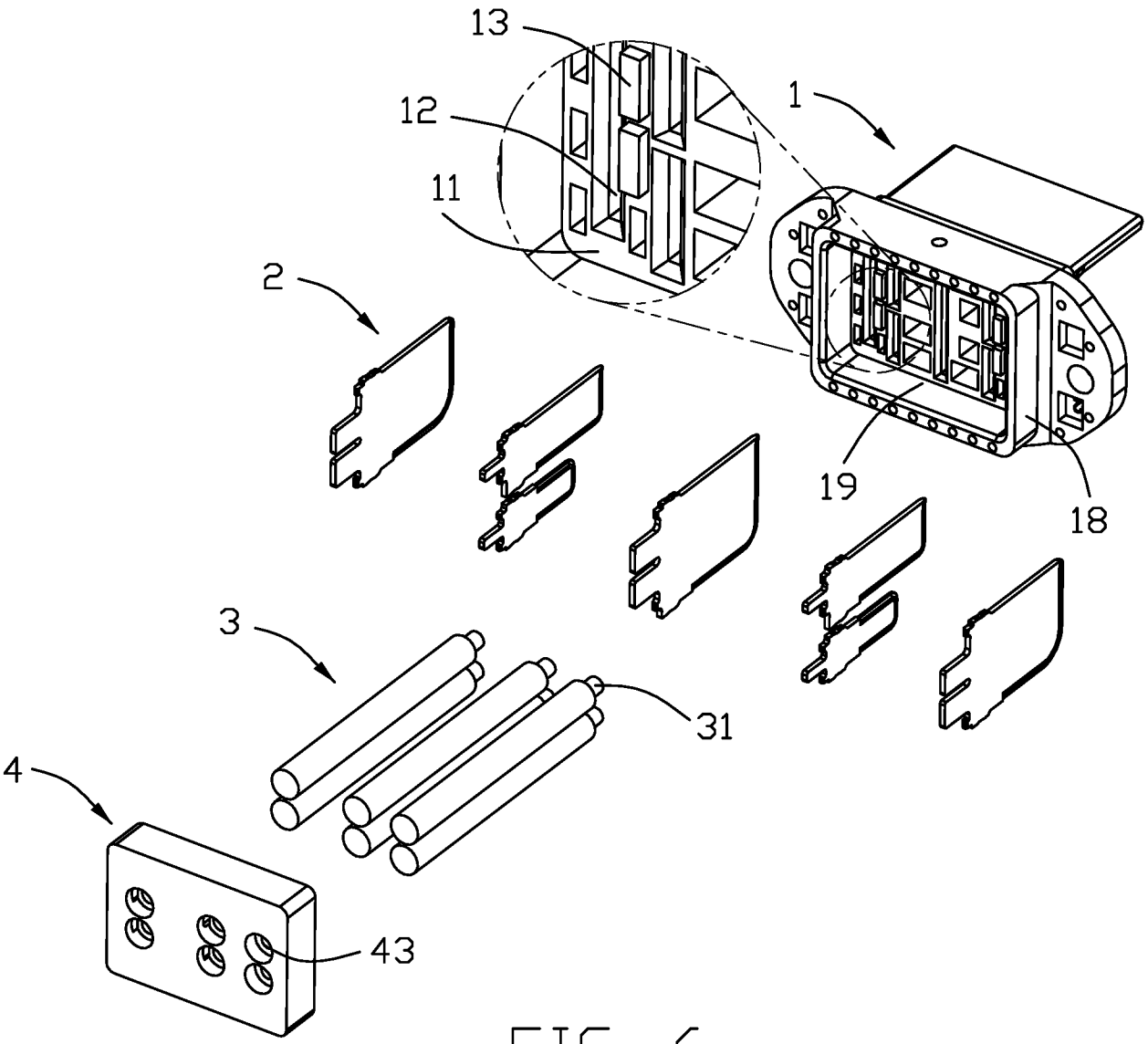
FIG. 6 is a further exploded perspective view of the electrical connector of FIG. 4
Figure 7:
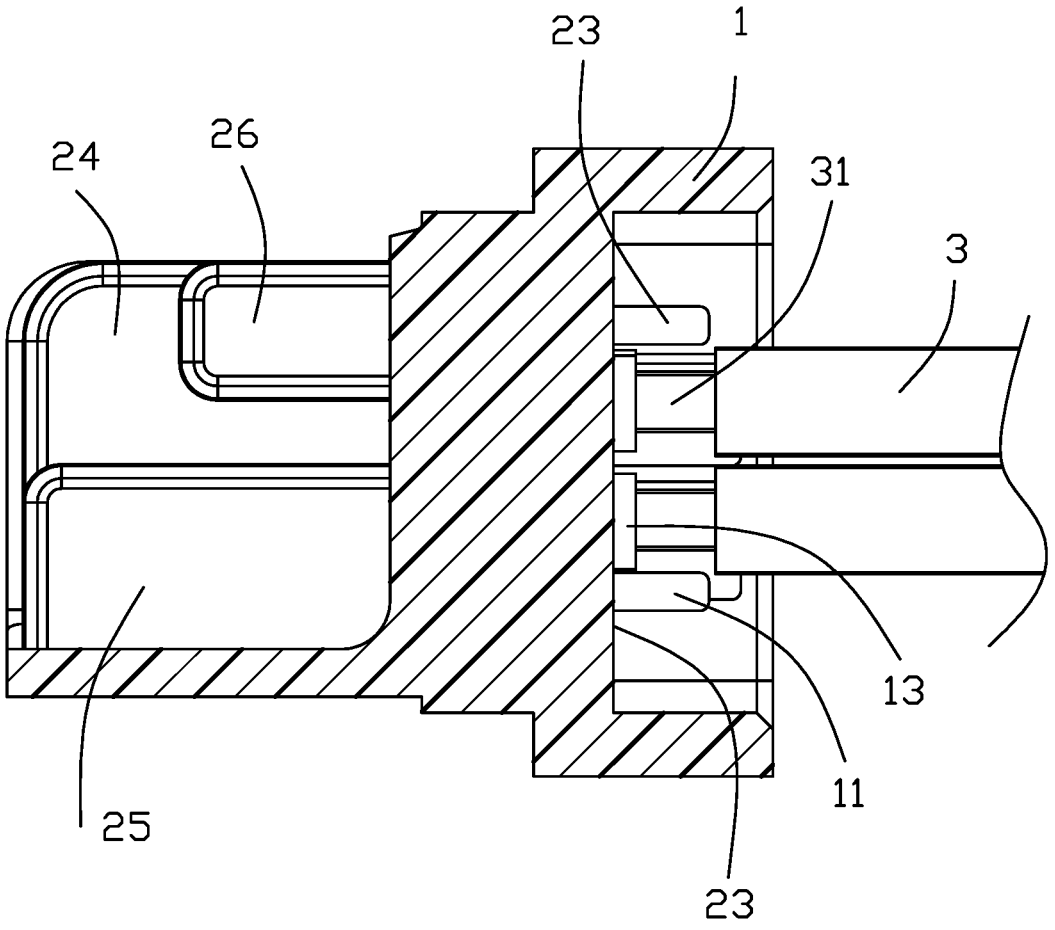
FIG. 7 is a cross-sectional view of the electrical connector of FIG. 1.
Figure 8:
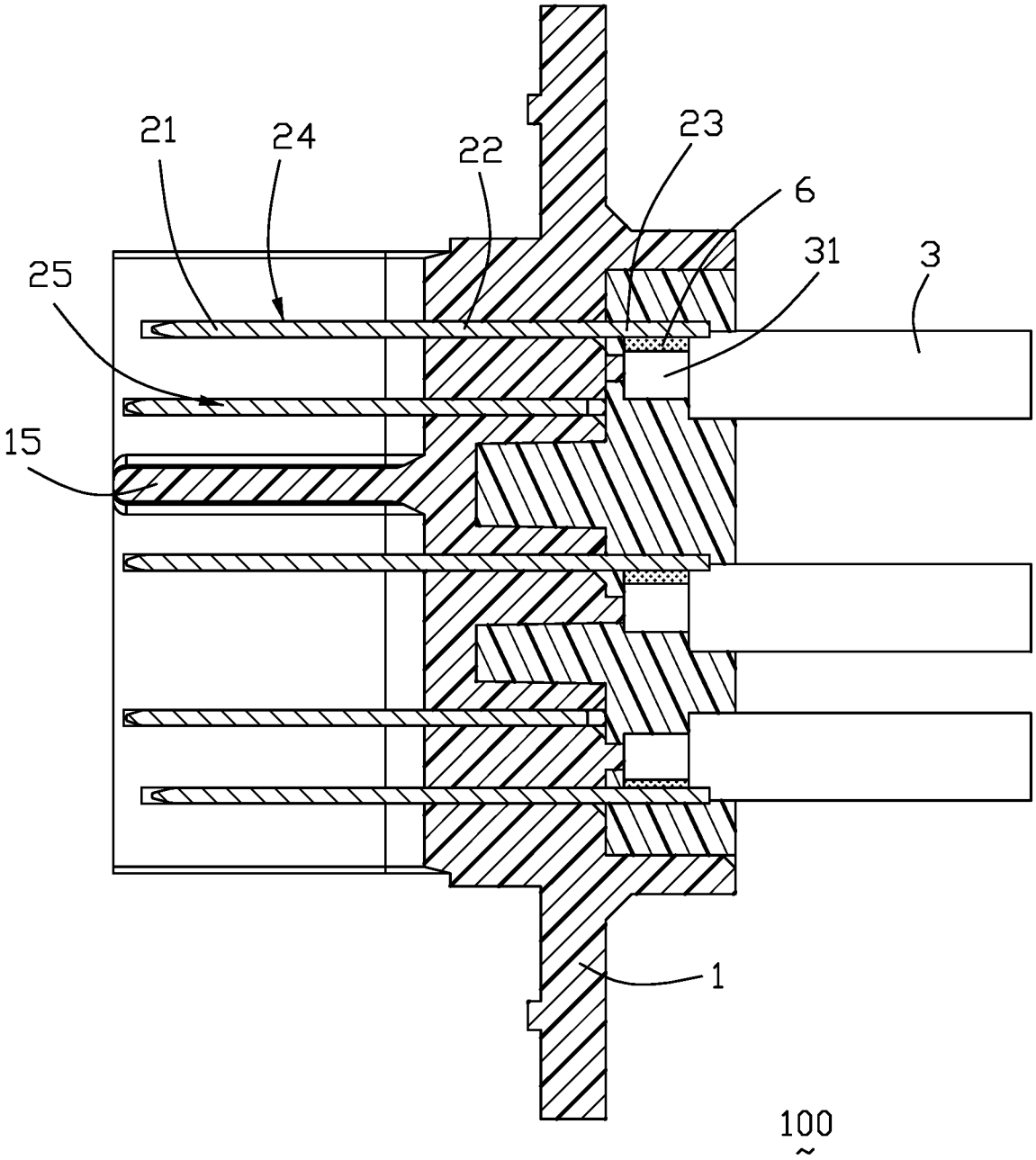
FIG. 8 is another cross-sectional view of the electrical connector of FIG. 1.

In this embodiment, as shown in FIG. 7, the soldering tails 23 of the paired second contact 25 and third contact 26 are essentially offset from the inner conductors 31 of the wires 3 which are soldered upon the corresponding soldering tail 23 of the neighboring first contact 24, thus avoiding the shorting risks. In this embodiment, the wires soldered to the soldering tails of the paired second contact 24 and third contact 26 are not omitted. As shown in both the FIGS. 7 and 8, the standoff 13 is longer than the diameter of the inner conductor 31 of the wire 3 in the vertical direction perpendicular to the front-to-back direction while is shorter than the diameter of the inner conductor 31 of the wire 3 in the transverse direction perpendicular to the front-to-back direction and the vertical direction. This arrangement allows the glue plate 4 to easily flow to reach the rear face 11 during pouring the fluidal glue into the receiving cavity 19. As shown in FIGS. 3 and 5, an inner face of the glue plate 4 forms a plurality of openings 41 to receive the corresponding soldering tails 23, and a plurality of openings 42 to receive the corresponding standoffs 13. Oppositely, the outer face of the glue plate 4 forms a plurality of openings 43 to receive the corresponding wires only, as shown in FIGS. 4 and 6.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing defining a plurality of slit type passageways extending in a front-to-back direction, a front mating port, and a rear receiving cavity forwardly communicating with the passageways with a rear face rearwardly facing toward an exterior;

a plurality of blade type contacts disposed in the housing, respectively, each of the contacts including a front contacting section exposed in the mating port, a middle retaining section retained in the corresponding passageway, and a rear soldering tail exposed in the receiving space;

a plurality of wires each including an exposed inner conductor soldered to the soldering tail of the corresponding contact; and a waterproof glue plate filling the receiving cavity; wherein a plurality of standoffs are formed on the rear face adjacent to the soldering tails of the corresponding contacts, respectively, and front end sections of the exposed inner conductors of the wires forwardly confront the corresponding standoffs in the front-to-back direction so as to assure the glue plate contacts the rear face without blocking;

wherein the contacts include a plurality of first contacts, second contacts and third contacts, the second contacts and the third contacts are smaller than the first contacts in a vertical direction perpendicular to the front-to-back direction and paired together in said vertical direction, and the standoffs are aligned, in the front-to-back direction, with the wires soldered to the soldering tails of the first contacts;

wherein the front mating port defines an L-shaped configuration, and the front contacting sections of the contacts are exposed in the front mating port;

wherein in a rear view, the standoff is offset from the soldering tail of the neighboring contact in a vertical direction perpendicular to the front-to-back direction so as to avoid shorting between two soldering tails of the two neighboring contacts.

2. The electrical connector as claimed in claim 1, wherein the front end section of the exposed inner conductor of the wire abuts against the corresponding standoff in the front-to-back direction.

3. The electrical connector as claimed in claim 1, wherein the standoff is longer than a diameter of the inner conductor of the wire in a vertical direction perpendicular to the front-to-back direction while shorter than the diameter of the inner conductor of the wire in a transverse direction perpendicular to both the front-to-back direction and the vertical direction.

4. The electrical connector as claimed in claim 1, wherein the glue plate encloses the standoffs, the soldering tails of the contacts, and the exposed inner conductors of the wires.

5. The electrical connector as claimed in claim 1, wherein the soldering tail of the contact defines a notch, and two inner conductors of two of said wires are respectively soldered to two opposite positions of the soldering tail of the contact by two sides of the notch in a vertical direction perpendicular to the front-to-back direction.

6. The electrical connector as claimed in claim 1, wherein the contacts include a plurality of first contacts, second contacts and third contacts, the second contacts and the third contacts are smaller than the first contacts and paired together in said vertical direction, and the notch is formed in the soldering tail of the corresponding first contact.

7. The electrical connector as claimed in claim 1, wherein the contacting section of the contact is plated with both Palladium-Nickel (Pd—Ni) and Gold (Au).

8. The electrical connector as claimed in claim 1, wherein an inner face of the glue plate forms a plurality of openings to receive the standoffs and the soldering tails of the contacts, respectively.

9. An electrical connector comprising:

an insulative housing defining a plurality of slit type passageways extending in a front-to-back direction, a front mating port, and a rear receiving cavity forwardly communicating with the passageways with a rear face rearwardly facing toward an exterior;

a plurality of blade type contacts disposed in the housing, respectively, each of the contacts including a front contacting section exposed in the mating port, a middle retaining section retained in the corresponding passageway, and a rear soldering tail exposed in the receiving space;

a plurality of wires each including an exposed inner conductor soldered to the soldering tail of the corresponding contact; and a waterproof glue plate filling the receiving cavity; wherein the soldering tail of the contact defines a notch, and two inner conductors of two of said wires are respectively soldered to two opposite positions of the soldering tail of the contact by two sides of the notch in a vertical direction perpendicular to the front-to-back direction;

wherein the contacts include a plurality of first contacts, second contacts and third contacts, the second contacts and the third contacts are smaller than the first contacts and paired together in said vertical direction, and the notch is formed in the soldering tail of the corresponding first contact;

wherein in a side view along a transverse direction perpendicular to both the front-to-back direction and the vertical direction, the soldering tails of the paired second contact and third contacts are located outwardly offset, in the vertical direction, from the two inner conductors of the two wires soldered to the two opposite positions of the neighboring tail of the neighboring first contact;

wherein a dimension of the standoff is larger than a diameter of the inner conductor in said vertical direction while is smaller in a transverse direction perpendicular to the both the vertical direction and the vertical direction.

10. The electrical connector as claimed in claim 9, wherein the rear face forms a plurality of standoffs adjacent to the corresponding first contacts while aligned, in the front-to-back direction, with the corresponding wires soldered to the first contacts, respectively.

11. The electrical connector as claimed in claim 9, wherein a waterproof glue plate is received within the receiving cavity to enclose the inner conductors of the wires and the soldering tails of the contacts.

12. The electrical connector as claimed in claim 11, wherein said rear face forms a plurality of standoffs beside the soldering tails of the corresponding contacts, respectively, and an inner face of the glue plate forms a plurality of openings to receive the corresponding standoffs, respectively.

* * * * *